US005975725A

United States Patent [19]

Ireland-Stacy

[11] Patent Number: 5,975,725

[45] Date of Patent: Nov. 2, 1999

[54] LAMP SHADE FOR DECORATIVELY ILLUMINATING AND CONCEALING INCLUSION THEREIN

[76] Inventor: Shirl Ireland-Stacy, P. O. Box 222, Pease Hill Rd., Adirondack, N.Y. 12808

[21] Appl. No.: 08/924,279

[22] Filed: Sep. 5, 1997

[51] Int. Cl.[6] ..... F21V 1/16

[52] U.S. Cl. ..... 362/357; 362/351

[58] Field of Search ..... 362/351, 355, 362/356, 357, 360, 361; D26/118, 124, 125, 126, 127; 493/950

[56] References Cited

U.S. PATENT DOCUMENTS

| | | | |
|---|---|---|---|
| 1,459,715 | 6/1923 | Bliss | 362/357 |
| 4,001,576 | 1/1977 | Goddard | 362/357 |
| 4,068,120 | 1/1978 | Throckmorton et al. | 362/351 |
| 4,268,896 | 5/1981 | Mann | 362/311 |
| 4,539,631 | 9/1985 | Lieberman | 362/351 |
| 5,121,312 | 6/1992 | Hyland et al. | 362/352 |
| 5,165,787 | 11/1992 | Holzhacker | 362/351 |
| 5,276,601 | 1/1994 | Holzhacker | 362/354 |
| 5,311,415 | 5/1994 | Hyland | 362/352 |
| 5,392,204 | 2/1995 | Schumaker | 362/294 |

*Primary Examiner*—Sandra O'Shea
*Assistant Examiner*—Michael J. Smith
*Attorney, Agent, or Firm*—Heslin & Rothenberg, P.C.

[57] ABSTRACT

The invention generally comprises a shade for covering a light source and a process for making the shade. The shade comprises an inner member and an outer member where the outer member is connected to the inner member. At least one inclusion is located between the inner member and the outer member wherein covering the light source with the shade enables viewing of the inclusion therein when the light source is in an on state and substantially prohibits viewing of the inclusion therein when the light source is in an off state.

20 Claims, 9 Drawing Sheets

LAMP SHADE FOR DECORATIVELY ILLUMINATING AND CONCEALING INCLUSION THEREIN

FIELD OF THE INVENTION

This invention relates generally to light covering fixtures. More particularly, the invention concerns a lamp shade for decoratively concealing and revealing inclusions therein depending on whether a light source is in an on or off state.

BACKGROUND OF THE INVENTION

Various shades exist in the prior art for covering lamps and lights. Of the decorative shades known, these devices operate on the principle that the means for providing a decorative appearance must reside on an outer surface of the shade itself. For example, U.S. Pat. No. 5,311,415 discloses a pleated outer cover, U.S. Pat. No. 5,276,601 discloses a shade having an outer cover of spaced pivoting light deflectors and U.S. Pat. No. 4,268,896 discloses a design placed on the surface of a panel that comprises the lamp shade.

A need exists to provide what appears to be a lamp shade with a standard covering, decorative or otherwise, but which also provides decorative features when light projects from a back surface to a front surface of the shade. In this regard, some of the most pleasing decorative features desired for shade covers comprise articles of nature such as botanicals. This presents a problem however. Existing shades cannot provide decorative features in combination with existing shade materials wherein the three dimensional botanical decorative features are selectively visible through the shade dependent on whether the light source is illuminated.

The invention disclosed herein solves these problems and deficiencies in the prior art by providing a novel shade construction and operation. As will be described in greater detail hereinafter, the shade of the present invention overcomes the shortcomings of those previously proposed.

SUMMARY OF THE INVENTION

According to my present invention I have provided a shade for covering a light source. The shade generally includes an inner member attached to a frame which is connectable to the light source in any conventional manner. An outer member is connected to the inner member wherein an inclusion, which may comprise a number of similar or varied inclusions, is located between the inner member and the outer member. Then, when the shade is connected adjacent the light source and at least partially covering the same, the inclusion(s) in the shade are visible for viewing through the outer member when the light source is in an on state and the shade substantially prohibits viewing of the inclusion(s) therein when the light source is in an off state.

Another feature of my invention concerns a process for making a shade for decoratively shading an illumination source. The process comprises the step of forming an inner member and preferably connecting the inner member to a frame which is connectable to the illumination source. Next, an inclusion may be located adjacent the inner member and secured by appropriate means. Then, an outer member is connected to the inner member about the perimeter of the inner member in selectively spaced relation therefrom. In this way, the outer member presses against the inclusion therebetween while maintaining a substantially uniform outer most surface. Further, the outer member is constructed wherein when the illumination source is in an on state the inclusion is visible through the outer member and when the illumination source is in an off state the outer member substantially conceals the inclusion from viewing.

According to important features of my invention I have also provided the inner and outer members comprising a semi-rigid material wherein the outer member comprises at least a two-layer construction and wherein a shade wall has a substantially uniform thickness across a mid-portion of the inner and outer members.

In accordance with the following, it is an advantage of the present invention to provide a lamp shade which incorporates three dimensional inclusions that are illuminated and visible when a lamp is on and substantially hidden from view when the lamp is off.

Another advantage is to maintain the surface appearance of the shade's inner and outer surfaces wherein the surfaces do not noticeably buckle, bulge or wrinkle irregularly to reveal that the inclusions are located in the shade.

Still another advantage is to protect the inclusions in a flat-like position between semi-rigid layers within the shade, preferably in a fixedly pressed position therein, which also enhances the longevity of the shade.

DESCRIPTION OF THE DRAWINGS

Other features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
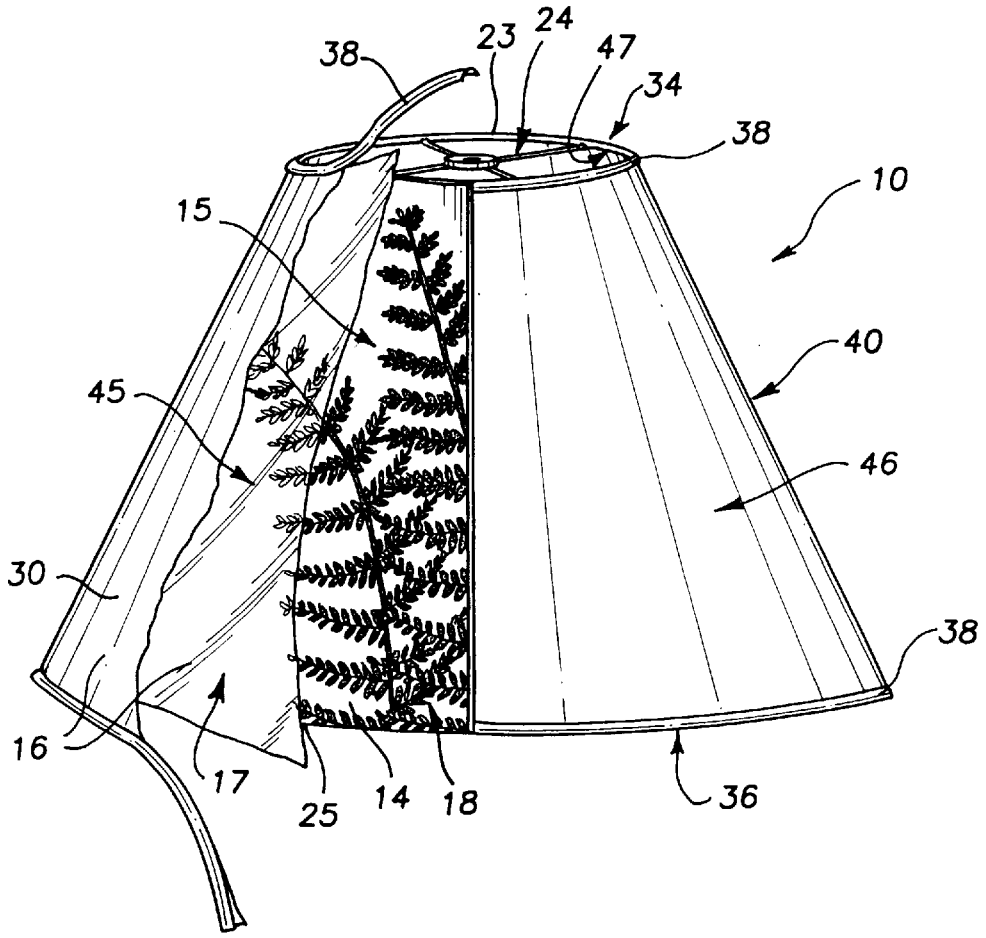
FIG. 1 is a perspective view of a shade partially assembled, in accordance with the features of my invention.
Figure 2:
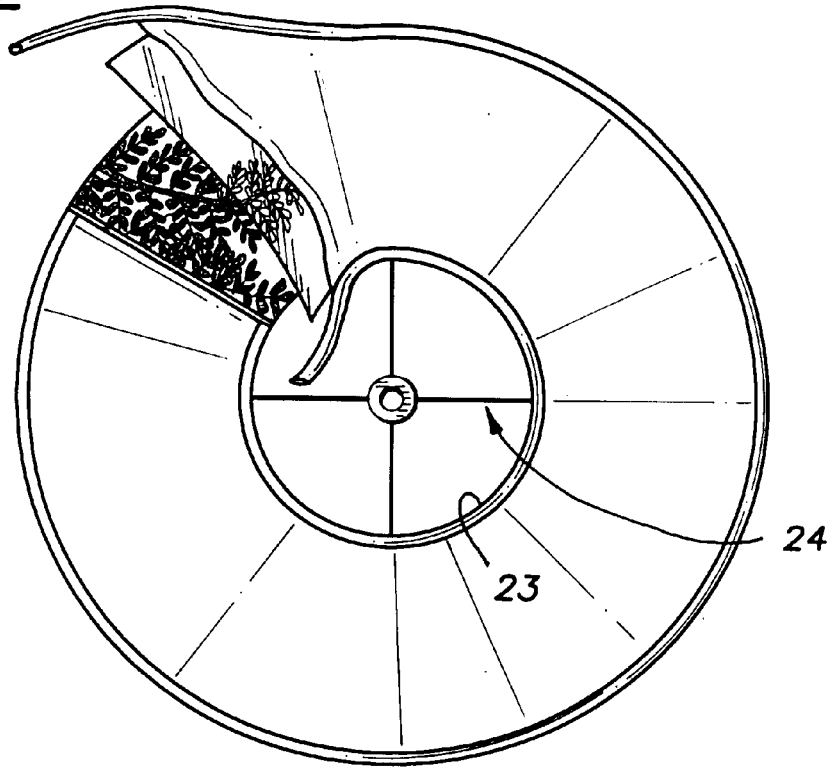
FIG. 2 is a reduced size top view of the shade in FIG. 1.
Figure 3:
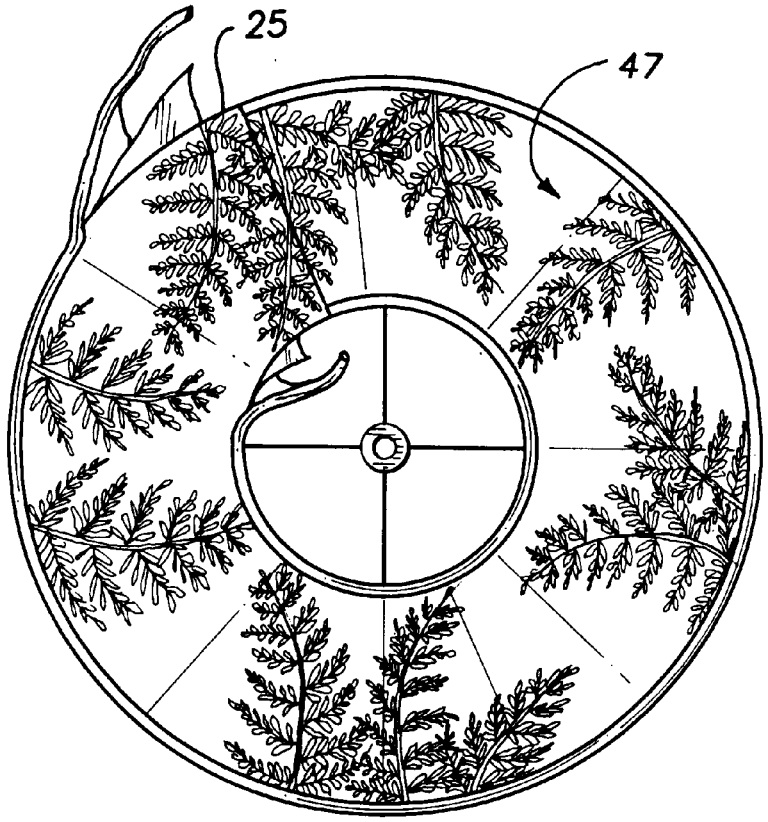
FIG. 3 is a reduced size bottom view of the shade in FIG. 1.

Referring now to the drawings, my invention comprises a shade 10 preferably including a frame 24 for attaching the shade adjacent a light or illumination source 12, preferably located at an upper portion of the illumination source. Excellent results are obtained when the light source comprises a lamp 26 including a lighting or lumination member 28.

An inner member 14 is connected to the frame 24 and configured to circumscribe at least a portion of the lumination member. An outer member 16 is selectively spaced from the inner member 14 and located adjacent the outer perimeter or outer most surface 44 of the inner member. The outer member is sized to extend substantially co-extensive vertically and horizontally in relation to the inner member.

An inclusion is located between the inner and outer members. Preferably, the inclusion is positioned in a flat-like position sandwiched between the inner and outer members. Generally the inclusion is the only means that selectively spaces the inner and outer members apart from one another wherever it is located therebetween. The inclusions preferably comprise dried natural botanicals such as leaves, stems and branches of ferns, ivies, oak trees, maple trees, cedar trees, etc. Although the inclusions shown in the drawings are in particular configurations, it should be understood that the inclusion could comprise various arrangements and configurations, various spacing therebetween, various density, one or many of the same or varied botanicals, and, be combined with various shade structure configurations and shapes.

Figure 4:
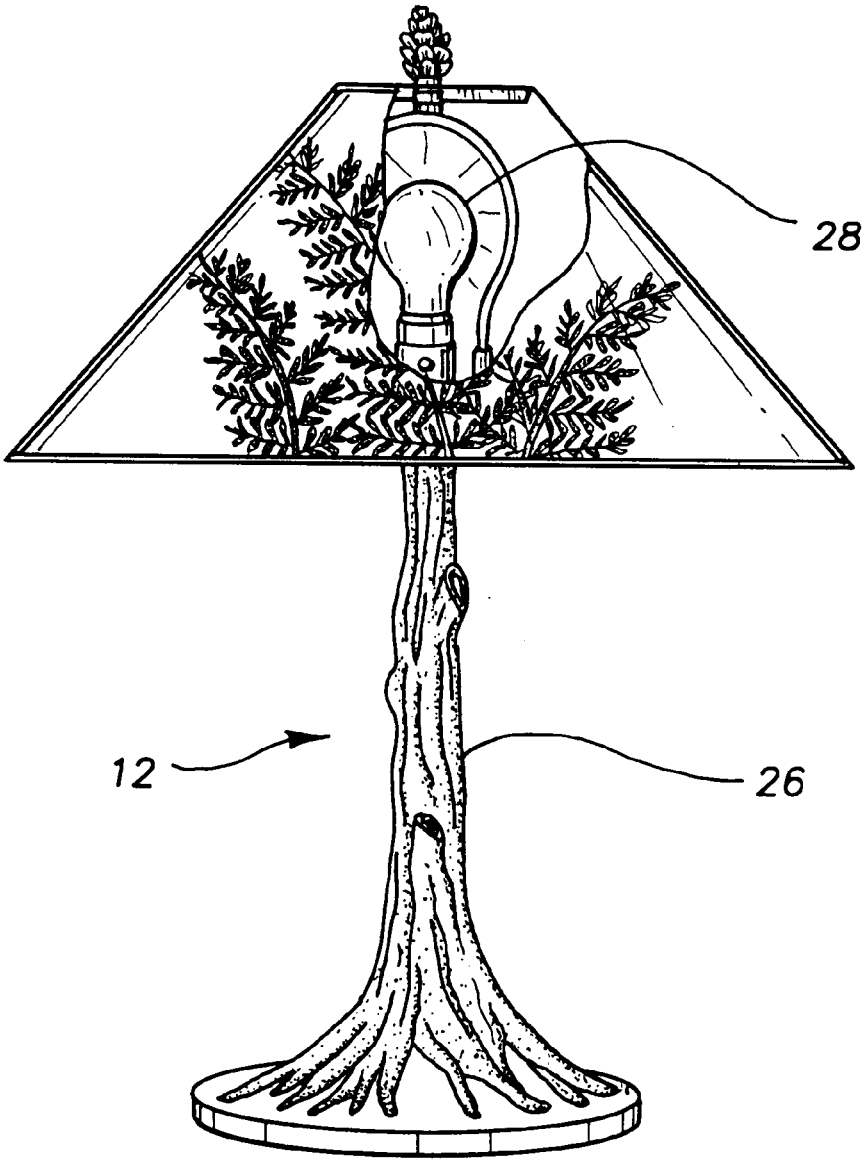
FIG. 4 is a front view of another embodiment of a shade in accordance with the features of my invention, where a portion of the shade has been cut away, the shade is completely assembled and connected to a light source and the light source is in an on state.
Figure 5:
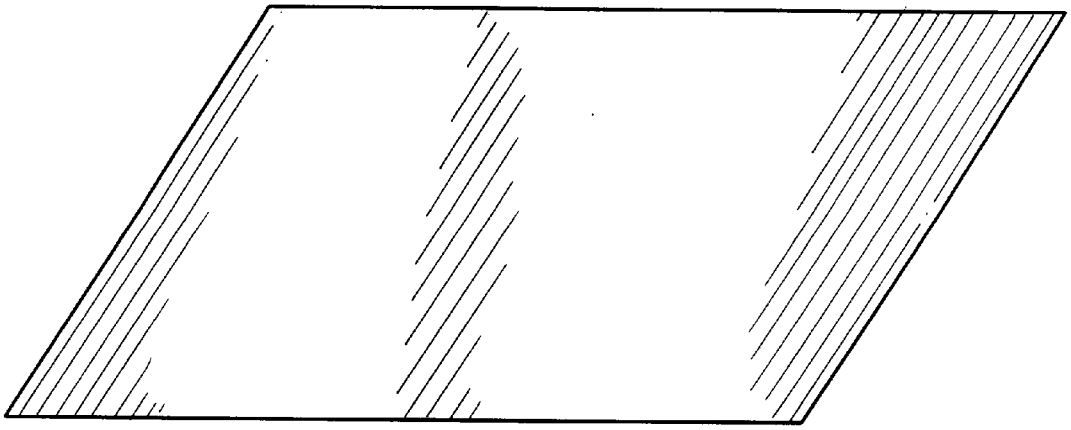
FIG. 5 is front view of a shade material portion as it would appear if an illumination source located behind the material portion is in an off state.
Figure 6:
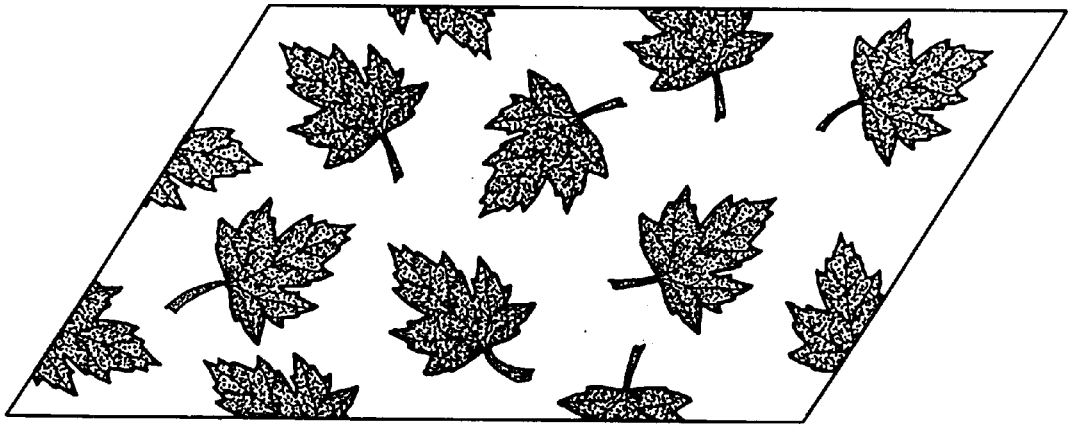
FIG. 6 is front view of a shade material portion as it would appear if an illumination source located behind the material portion is in an on state.
Figure 7C:
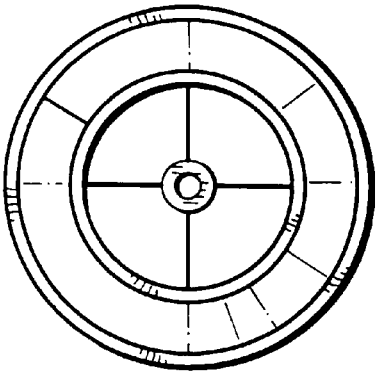
FIG. 7*c* is top view of the shade in FIG. 7*a;*
Figure 7D:
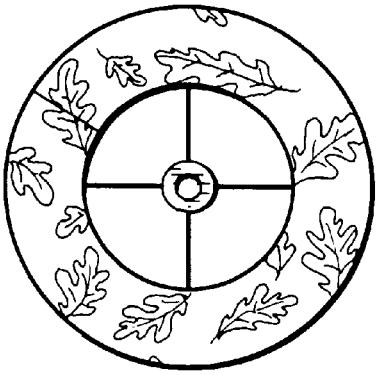
FIG. 7*d* is bottom view of the shade in FIG. 7*a;*
Figure 7A:
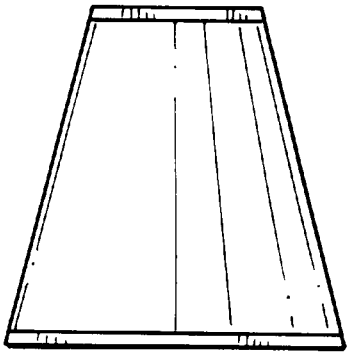
FIG. 7*a* is front view of another embodiment of a shade, in accordance with the features of my invention, as it would appear if an illumination source located behind the material portion is in an off state, and where a back 180 degree view is a mirror image of the front view.
Figure 7B:
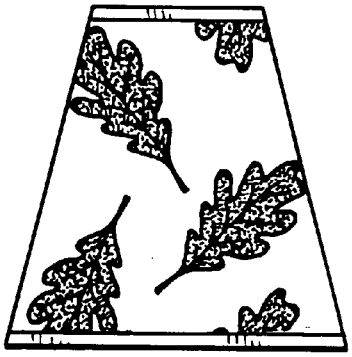
FIG. 7*b* is front view of the shade in FIG. 7*a,* where the illumination source is in an on state and where a back 180 degree view is a mirror image of the front view.
Figure 8C:
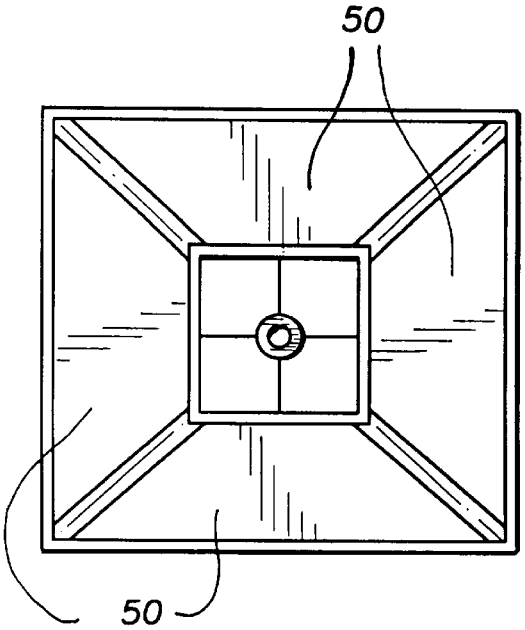
FIG. 8*c* is top view of the shade in FIG. 8*a;*
Figure 8D:
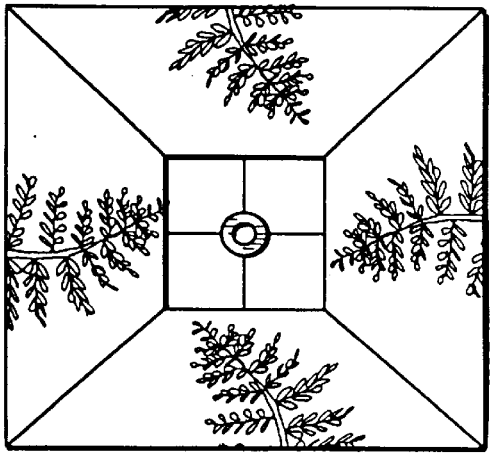
FIG. 8*d* is bottom view of the shade in FIG. 8*a;*
Figure 8A:
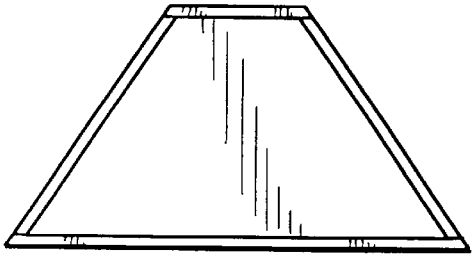
FIG. 8*a* is front view of yet another embodiment of a shade, in accordance with the features of my invention, as it would appear if an illumination source located behind the material portion is in an off state, and where a back 180 degree view is a mirror image of the front view.
Figure 8B:
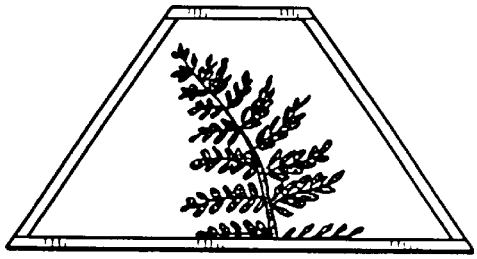
FIG. 8*b* is front view of the shade in FIG. 8*a,* where the illumination source is in an on state and where a back 180 degree view is a mirror image of the front view.
Figure 10A:
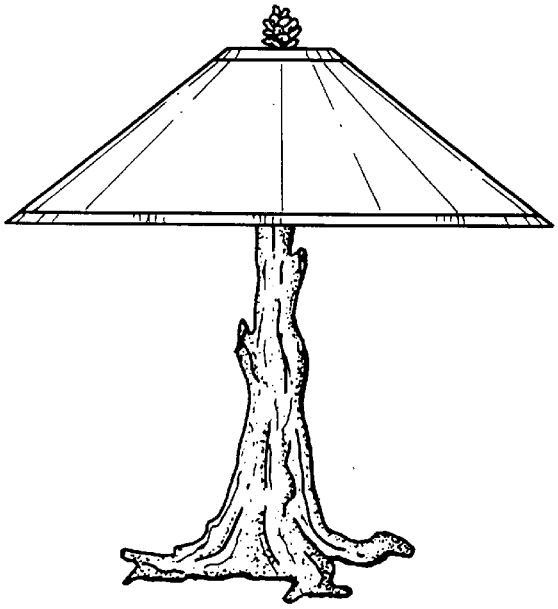
FIG. 10*a* is front view of a further embodiment of a shade, with an optional base or lamp, in accordance with the features of my invention, as it would appear if an illumination source located behind the material portion is in an off state, and where a back 180 degree view is a mirror image of the front view.
Figure 10B:
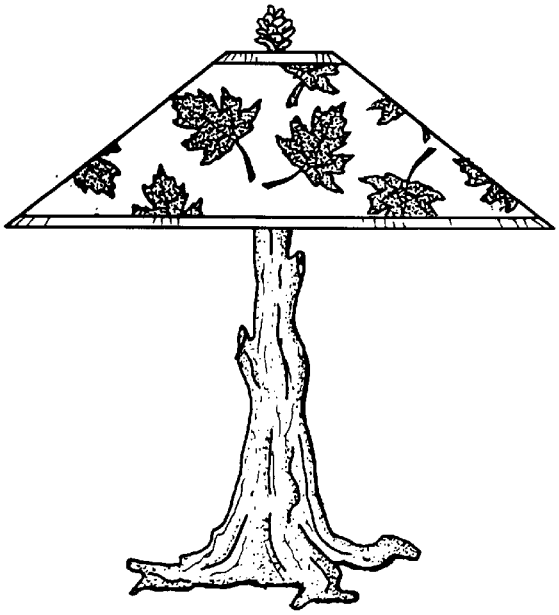
FIG. 10*b* is front view of the shade in FIG. 10*a,* where the illumination source is in an on state and where a back 180 degree view is a mirror image of the front view.
Figure 9A:
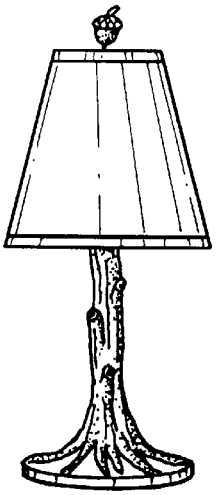
FIG. 9*a* is front view of still another embodiment of a shade, with an optional base or lamp, in accordance with the features of my invention, as it would appear if an illumination source located behind the material portion is in an off state, and where a back 180 degree view is a mirror image of the front view.
Figure 9B:
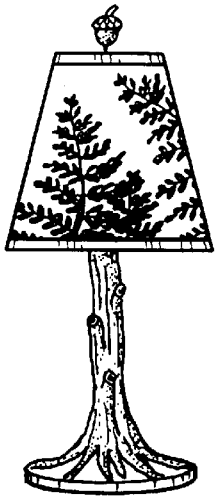
FIG. 9*b* is front view of the shade in FIG. 9*a,* where the illumination source is in an on state and where a back 180 degree view is a mirror image of the front view.
Figure 10E:
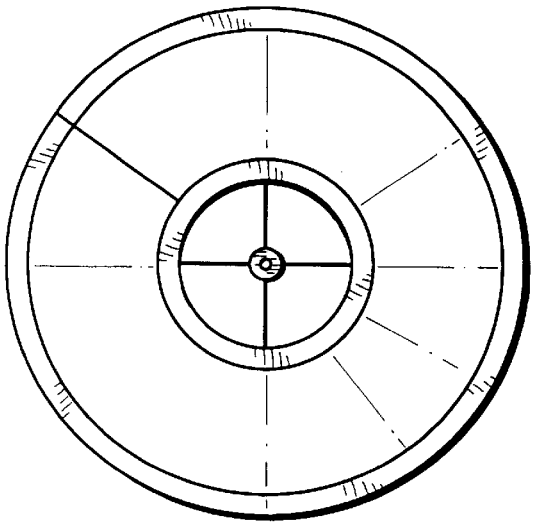
FIG. 10*e* is top view of the shade in FIG. 10*c;*
Figure 10F:
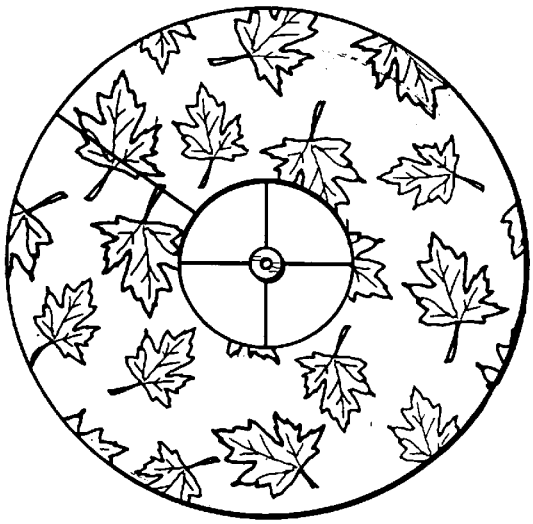
FIG. 10*f* is bottom view of the shade in FIG. 10*d;*
Figure 10C:
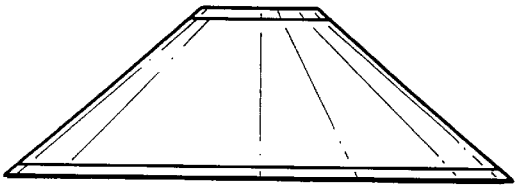
FIG. 10*c* is a slightly enlarged view of the shade in FIG. 10*a,* without the option base or lamp.
Figure 10D:
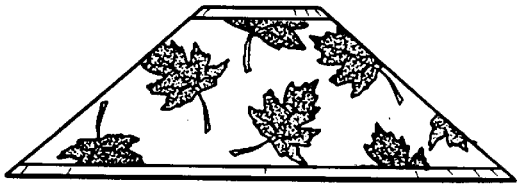
FIG. 10*d* is a slightly enlarged view of the shade in FIG. 10*b,* without the option base or lamp.
Figure 11A:
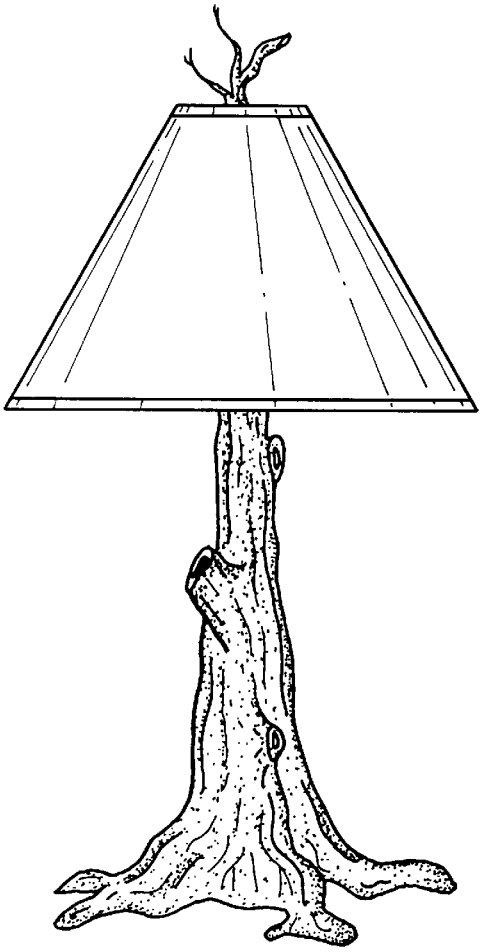
FIG. 11*a* is front view of still a further embodiment of a shade, with an optional base or lamp, in accordance with the features of my invention, as it would appear if an illumination source located behind the material portion is in an off state, and where a back 180 degree view is a mirror image of the front view; and, FIG. 11*b* is front view of the shade in FIG. 11*a,* where the illumination source is in an on state and where a back 180 degree view is a mirror image of the front view.
Figure 11B:
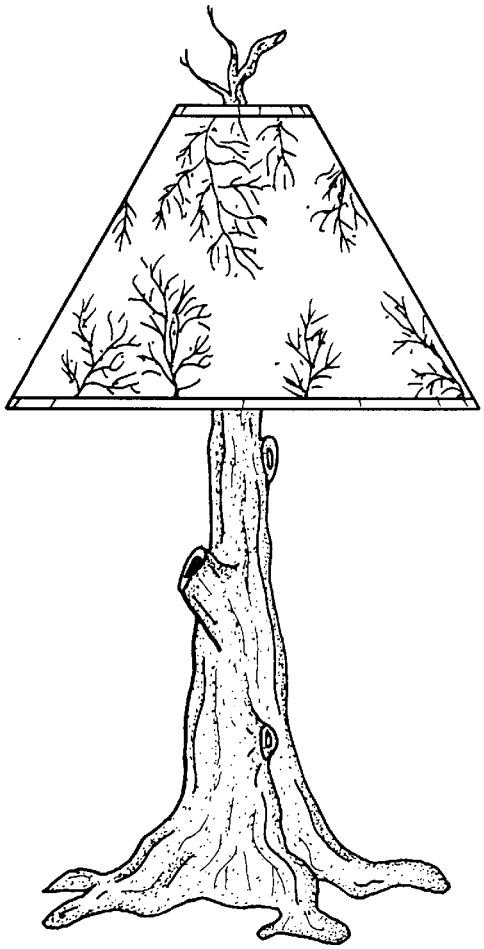

The outer member has a viewing characteristic wherein the inclusion is visible in the shade 10 when the illumination source is in an on state, see FIGS. 4 and 7*b* for example. Alternately, the viewing characteristic of the outer member further includes the inclusion appearing substantially non-visible when the lumination source is in an off state, see FIG. 7*a* for example.

In a preferred embodiment of the invention this viewing characteristic is obtained by the outer member comprising at least a two-layer construction. In this way, an outer most layer 30 of the outer member 16 has a substantially opaque viewing characteristic when the light source is in the off state. Also, the outer most layer has a translucent viewing characteristic when the light is in the on state wherein the inclusion, or a silhouetted image thereof, appears visible through the outer most layer 30. Excellent results are obtained when the outer most layer is constructed of a non-rigid material, such as handmade paper, machine made paper, cloth or standard shade coverings, as long as they possess the desired substantially opaque and translucent viewing characteristics.

A further feature of the invention relates to a decoratively illuminated shade that does not noticeably buckle or wrinkle due to the thickness of the inclusion therein and that also protects the inclusion therein. In this regard, excellent results are obtained when the inner and outer members comprise a semi-rigid material, and in particular styrene for the inner member and mylar or styrene for the outer member. In addition to protecting the inclusion, the rigidity of the inner and outer members prevent buckling and provide the shade with a substantially uniform outer surface 46. When the outer member comprises the two-layer construction discussed above, then preferably the outer member comprising mylar or styrene has a transparent or translucent viewing characteristic and the outer most layer 30 is attached thereto by an adhesive or the like.

Yet another feature of the invention comprises providing a clear viewable image of the inclusion when the light source is in the on state. To this end, excellent results are obtained when the outer member is substantially connected to the inner member and only selectively spaced therefrom by the inclusion located therebetween. In this way the light path through the shade wall 40, defined by the thickness from an inside surface 47 of the inner member to the outer surface 46, is substantially uniform for projecting a clear image of the inclusion through the outer member. In combination with this feature, a trim 38 preferably connects top and bottom edges, 34 and 36 respectively, to better maintain the edges in a secured together relationship, to decoratively cover the edges and to aid in securing the shade to the frame.

I have discovered a unique process for making such a shade that employs the features of my invention. In an embodiment of my invention comprising a continuous curved shade, such as seen in FIG. 1 for example, the following steps are preferred. First, a shade frame 24 is provided, preferably a conventional such frame. Then, the inner member 14, preferably comprising a layer of styrene at least fourteen point thick, is cut to size and connected to the frame by any conventional means. The frame preferably comprises a top hoop-like member 23 and a bottom hoop-like member 25. In this way the frame aids in providing additional rigidity to the constructed shade 10, as well as, serving to connect the shade to a light source.

Next, the inclusion(s) 18 are arranged on the styrene inner member 14. Preferably, the styrene has a pressure sensitive adhesive surface 15, or an adhesive is applied thereon, to which the inclusion is fixedly attached as it is arranged on the inner member. The outer member 16, preferably comprising at least a layer 45, of mylar of at least ten mil or styrene of at least fourteen point thickness, is then cut to a size and pattern corresponding to the inner member. The member 16 is preferably cut slightly larger than the size of the inner member and then trimmed to closely correspond to the size of the inner member once assembled per the next step. Next the outer member is wrapped snugly around the inclusions and the inner member and connected in place to the inner member, preferably substantially uniformly across their surfaces.

When the outer member comprises the two-piece construction, preferably the mylar or styrene layer includes a pressure sensitive outer adhesive coating 17 of an acrylic adhesive that is heat tolerant and permanent. Then, the outer most layer 30 is attached to the mylar (or styrene) and together the mylar (or styrene) and the layer 30 comprise the outer member 16. The outer most layer 30 may be attached to the mylar (or styrene) before or after the outer member is connected to the inner member. Yet additionally, an adhesive may be included on both sides of the mylar (or styrene) layer comprising the outer member. In this way, the inclusion is adhesively attached on opposite faces to the inner and outer members respectively and thereby the inclusion, the inner member and the outer member are integrally connected.

Finally, the trim 38 is connected over the top and bottom edges 34 and 36 respectively for more securely fixing the edges of the inner and outer members together and aiding to further secure the shade to the frame. It should be understood that it is preferable that the outer member be assembled to the inner member after the inner member is formed and the inclusion is arranged thereon. This way best prevents buckling or wrinkling of the inclusion and the overlying outer member. Further, then the inclusion remains tightly pressed within the layers of the inner and outer members and a clear silhouetted image can project through the outer member when the light source is in the on state.

Additionally, since both the inner and outer members have substantially uniform regular inner 46 and outer 47 respective surfaces and the outer member comprises a substantially opaque viewing characteristic, the shade appears to be a conventional shade when the light source is in the off state. It should be understood that for the outer surface 46 a uniform regular outer surface means one that does not have irregular buckles or wrinkles other than those intentionally provided by the texture and style of the outer most layer 30.

In an alternative embodiment of my invention comprising flat paneled shade components, the shade comprises multiple shade components 50, such as seen in FIGS. 8*a*–8*d* for example. Each component partially circumscribes the upper portion of the lumination source. Each component 50 is attached to the frame adjacent to another shade component and together they comprise a shade 10. The process for making this alternative embodiment is essentially the same. However, rather than connecting the formed inner member to the frame early in the process, the inner member is connected to frame after the inner member, inclusion and outer member are respectively formed, arranged and connected together. Finally, the trim is added to the top and bottom edges, similar to the previous embodiment.

As various possible embodiments may be made in the above invention for use for different purposes and as various changes might be made in the embodiments above set forth, it is understood that all of the above matters here set forth or shown in the accompanying drawings are to be interpreted as illustrative and not in a limiting sense.

I claim:

1. A shade for covering a light source comprising:

an inner member having an outer most surface;

an outer member, said outer member located adjacent the outer most surface; and at least one inclusion located between the inner member and the outer member wherein covering the light source with the shade enables viewing of the inclusion therein through the outer member when the light source is in an on state and substantially prohibits viewing of the inclusion therein through the outer member when the light source is in an off state.

2. The shade of claim 1, further comprising a frame connected to the inner member, the frame being connectable to the light source.

3. The shade of claim 1, wherein the inner and outer members comprise a semi-rigid material.

4. The shade of claim 3, wherein the semi-rigid material is mylar or styrene.

5. The shade of claim 1, wherein the outer member comprises at least a two-layer construction and wherein at least an outer most layer of the outer member has a substantially opaque viewing characteristic when the light source is in the off state.

6. The shade of claim 1, wherein opposed surfaces of the outer member and the inner member are separated from each other by the inclusion and are substantially connected together elsewhere.

7. The shade of claim 1, wherein a trim secures the inner and outer members together at top edge and bottom edges.

8. The shade of claim 1, wherein a shade wall, comprising the inner member the inclusion and the outer member, has a substantially uniform thickness through a portion thereof in a direction perpendicular to the outer most surface of the inner member.

9. The shade of claim 1, wherein the outer member is substantially uniform across an outer surface.

10. The shade of claim 1, wherein the inclusion comprises a natural botanical.

11. A lamp shade having a frame for attaching the lamp shade to a lamp including a lumination member, comprising:

an inner member connected to the frame and configured to circumscribe at least a portion of the rumination member;

an outer member substantially connected to the inner member wherein the outer member is selectively spaced from the inner member;

an inclusion sandwiched between the inner and outer members in a flat-like position; and the outer member having a viewing characteristic wherein the inclusion is visible in the lamp shade through the outer member when the lumination member is in an on state and the inclusion is substantially non-visible through the outer member when the lumination member is in an off state.

12. The lamp shade of claim 11, wherein an adhesive fixes the inclusion in position when sandwiched between the inner and outer members.

13. The lamp shade of claim 11, wherein the inner member, the outer member and the inclusion are integrally connected.

14. The lamp shade of claim 11, wherein the lamp shade comprises multiple shade components that each partially circumscribe the lumination member and are attached to the frame adjacent to another shade component.

15. The lamp shade of claim 11, wherein the inclusion comprises a natural botanical.

16. A process for making a shade for decoratively shading an illumination source, comprising the steps of:

forming an inner member;

affixing an inclusion to an outer most surface of the inner member; and locating an outer member adjacent to the inner member about the outer most surface of the inner member in selectively spaced relation therefrom wherein the outer member presses against the inclusion therebetween while maintaining a substantially uniform outer most surface thereof and wherein when the illumination source is in an on state the inclusion is visible through the outer member and when the illumination source is in an off state the outer member substantially conceals the inclusion from viewing through the outer member.

17. The method of claim 16, wherein the step of locating further comprises layering the outer member with an outer most layer having viewing characteristics wherein when the illumination source is in an on state the outer most layer has a translucent viewing characteristic and when the illumination source is in an off state the outer member has a substantially opaque viewing characteristic.

18. The method of claim 16, wherein the step of forming comprises sizing a first layer and attaching the first layer to a frame.

19. The method of claim 18, wherein the shade comprises multiple shade components formed independent of one another and attached to the frame adjacent to another shade component wherein the shade components cooperate to substantially circumscribe an upper portion of the illumination source.

20. The shade of claim 16, wherein the inclusion comprises a natural botanical.

* * * * *

UNITED STATES PATENT AND TRADEMARK OFFICE

CERTIFICATE OF CORRECTION

PATENT NO. : 5,975,725

DATED : November 02, 1999

INVENTOR(S) : Shirl Ireland-Stacy

It is certified that error appears in the above-identified patent and that said Letters Patent is hereby corrected as shown below:

IN THE CLAIMS:

Claim 11, Col. 6, line 43, delete "rumination" and replace with --lumination--.

Signed and Sealed this

Thirtieth Day of May, 2000

*Attest:*

Q. TODD DICKINSON

*Attesting Officer*

*Director of Patents and Trademarks*